US010502467B2

(12) United States Patent
Koch et al.

(10) Patent No.: US 10,502,467 B2
(45) Date of Patent: Dec. 10, 2019

(54) REFRIGERATION APPLIANCE COMPRISING A CLEANING DEVICE

(71) Applicant: BSH HAUSGERAETE GMBH, Munich (DE)

(72) Inventors: Alexander Koch, Neu-Ulm (DE); Niels Liengaard, Ulm (DE)

(73) Assignee: BSH Hausgeraete GmbH, Munich (DE)

( * ) Notice: Subject to any disclaimer, the term of this patent is extended or adjusted under 35 U.S.C. 154(b) by 21 days.

(21) Appl. No.: 15/520,961

(22) PCT Filed: Oct. 15, 2015

(86) PCT No.: PCT/EP2015/073887
§ 371 (c)(1),
(2) Date: Apr. 21, 2017

(87) PCT Pub. No.: WO2016/062612
PCT Pub. Date: Apr. 28, 2016

(65) Prior Publication Data

US 2017/0343256 A1 Nov. 30, 2017

(30) Foreign Application Priority Data

Oct. 22, 2014 (DE) ..... 10 2014 221 409

(51) Int. Cl.
*F25B 39/04* (2006.01)
*F25B 39/02* (2006.01)
*F25D 23/12* (2006.01)

(52) U.S. Cl.
CPC ..... *F25B 39/04* (2013.01); *F25B 39/022* (2013.01); *F25D 23/12* (2013.01); *F25D 2400/22* (2013.01)

(58) Field of Classification Search
CPC ..... F25D 23/12; F25D 2400/22; F25B 39/04; F25B 39/022
See application file for complete search history.

(56) References Cited

U.S. PATENT DOCUMENTS 1,985,156 A * 12/1934 Fieldhouse ..... F28G 3/10 165/84
5,211,028 A * 5/1993 Remo ..... F28G 1/02 165/94

(Continued)

FOREIGN PATENT DOCUMENTS

FR 2766560 A1 1/1999
WO 2014053366 A1 4/2014
WO WO2014053366 A1 * 4/2014

*Primary Examiner* — Emmanuel E Duke
(74) *Attorney, Agent, or Firm* — Laurence A. Greenberg; Werner H. Stemer; Ralph E. Locher

(57) ABSTRACT

A refrigeration appliance has a refrigeration appliance component and a cleaning device for cleaning the component. The cleaning device includes a cleaning element, an actuating element, and a connection element. The cleaning element is connected to the actuating element by the connection element. The refrigeration appliance has a cavity which extends from the front side of the refrigeration appliance to the back side of the refrigeration appliance, and in which the connection element is accommodated. The cleaning element is moveable across a surface of the refrigeration appliance component upon actuation of the actuating element in order to remove dirt deposits from the surface of the refrigeration appliance component.

13 Claims, 5 Drawing Sheets

(56) References Cited

U.S. PATENT DOCUMENTS

| | | | | |
|---|---|---|---|---|
| 6,041,612 | A * | 3/2000 | Stringer | F28G 1/02 165/95 |
| 7,624,470 | B2 * | 12/2009 | Heyman | F28G 1/166 15/301 |
| 2008/0120802 | A1 * | 5/2008 | Harvey | B08B 3/028 15/405 |
| 2011/0296641 | A1 * | 12/2011 | Kim | F28G 1/02 15/160 |
| 2012/0167609 | A1 * | 7/2012 | Kim | F24F 1/14 62/303 |
| 2016/0123684 | A1 * | 5/2016 | Kim | F28G 3/04 15/246 |

* cited by examiner

REFRIGERATION APPLIANCE COMPRISING A CLEANING DEVICE

BACKGROUND OF THE INVENTION

Field of the Invention

The present invention relates to a refrigeration appliance with a cleaning device.

During operation of a refrigeration appliance, refrigeration appliance components are used to operate the refrigeration circuit, thereby ensuring adequate cooling of the refrigeration appliance. During the operation of the refrigeration appliance, refrigeration appliance components can generate heat. In order to dissipate the heat produced from the refrigeration appliance components, an air cooler is used in refrigeration appliances, with which a flow of air is routed past the refrigeration appliance components for cooling purposes. By supplying the flow of air, dirt deposits may appear on the refrigeration appliance components during the period of operation of the refrigeration appliance.

SUMMARY OF THE INVENTION

It is the object of the present invention to specify a refrigeration appliance, with which an effective function of refrigeration appliance components is ensured during the operating time of the refrigeration appliance.

This object is achieved by a subject matter having the features as claimed in the independent claim. Advantageous embodiments form the subject matter of the dependent claims, the description and the drawings.

According to one aspect, the inventive object is achieved by a refrigeration appliance with a refrigeration appliance component and with a cleaning device for cleaning the refrigeration appliance component, wherein the cleaning device comprises a cleaning element, an actuating element and a connection element, wherein the cleaning element is connected to the actuating element by the connection element, wherein the refrigeration appliance comprises a cavity which extends from the front side of the refrigeration appliance to the back side of the refrigeration appliance, and in which the connection element is accommodated, and wherein upon actuation of the actuating element the cleaning element is movable across a surface of the refrigeration appliance component in order to remove dirt deposits from the surface of the refrigeration appliance component.

As a result, the technical advantage is achieved for instance that an effective cleaning of the refrigeration appliance component is ensured by the use of the refrigeration appliance with the cleaning device.

The refrigeration appliance components of a refrigeration appliance are often reliant on an air cooler, in order to dissipate the heat produced during the cooling process and thus to ensure an effective function of the refrigeration circuit of the refrigeration appliance. Various refrigeration appliance components, such as a condenser for instance, must therefore be cooled during the cooling process by means of a flow of air provided by a fan. Various refrigeration appliance components may have wires or fins on the surface, in order to enlarge the surface of the refrigeration appliance component, such as e.g. the condenser. Impurities, such as e.g. dust particles, will continuously attach to the surface of refrigeration appliance components on account of a continuous flow of air. As a result, dirt deposits develop, which may affect the function of the refrigeration appliance component and are therefore to be removed at certain intervals during operation of the refrigeration appliance. Since most of the refrigeration appliance components are installed in the interior of the refrigeration appliance, and are mostly disposed on the back side of the refrigeration appliance, cleaning by the user is as a result often ruled out since it is not possible for the user to reach the surface of the refrigeration appliance components.

The inventive cleaning device requires the cleaning element, which is arranged in the interior of the refrigeration appliance on the surface of the refrigeration appliance component to be cleaned. The cleaning element is connected to the connection element, which is attached in the cavity of the refrigeration appliance, which in turn extends from the front side of the refrigeration appliance to the back side of the refrigeration appliance. The connection element is moreover connected to the actuating element, which can be actuated from the front side of the refrigeration appliance by the user of the refrigeration appliance.

Upon actuation of the actuating element by the user, the actuating element is moved in different directions. The movement of the actuating element is transmitted by the connection element onto the cleaning element in the interior of the refrigeration appliance. As a result, in accordance with the direction of movement of the actuating element, the cleaning element is moved across the surface of the refrigeration appliance, as a result of which dirt deposits can be effectively removed from the surface of the refrigeration appliance component.

Therefore, by using the cleaning device it is possible to achieve a simple and effective removal of dirt deposits from the surface of the refrigeration appliance component. As a result, the quantity of dirt deposits on the surface of the refrigeration appliance component can be reduced, as a result of which the effective function of the refrigeration appliance component of the refrigeration appliance is ensured during the operating time of the refrigeration appliance.

A refrigeration appliance is in particular understood to mean a domestic refrigeration appliance, in other words a refrigeration appliance which is used for housekeeping purposes in homes or in the field of gastronomy, and serves in particular to store food and/or beverages at certain temperatures, like for instance a refrigerator, an upright freezer, a fridge/freezer, a chest freezer or a wine chiller.

In an advantageous embodiment of the refrigeration appliance, the cleaning element comprises a brush or a lip.

As a result, the technical advantage is achieved that an effective cleaning of the surface of the refrigeration appliance component is achieved by using a brush or a lip. Since a brush comprises a number of brush fibers, which are flexible and which adjust to the surface structure when moving across the surface of the refrigeration appliance component, dirt deposits can also be effectively removed from areas of the surface, such as indentations or elevations, which are difficult to reach. A lip comprises a flexible and elastic component consisting of a component part, which can be used to clean a flat surface, wherein during the cleaning the edge of the lip is in contact with the surface. The lip can comprise a wiper blade for instance. For this reason the lip is suited to cleaning flat areas of surfaces.

In a further advantageous embodiment of the refrigeration appliance, the brush comprises a brush rear and a brush edging, or the lip comprises a lip rear or a lip edging, wherein the brush edging comprises synthetic fibers, natural fibers or metal fibers, or wherein the lip edging comprises a flexible plastic flange.

As a result, the technical advantage is achieved that an effective cleaning of the surface of the refrigeration appliance component is permitted by using a brush or a lip edging made of the cited materials. Synthetic, natural and metal fibers as well as the plastic flange are characterized by a large stability and flexibility, as a result of which an effective cleaning effect is achieved. The brush or lip edging is in direct contact with the surface to be cleaned and is actively fastened to the brush or lip rear. The brush or lip rear is connected to the connection element, which is in turn connected to the actuating element. With a cleaning process by the cleaning element, the brush or lip rear is moved, as a result of which the brush or lip edging, which is in direct contact with the surface of the refrigeration appliance component, is moved across the surface of the refrigeration appliance component and dirt deposits can as a result be effectively removed from the surface.

In a further advantageous embodiment of the refrigeration appliance, the actuating element is arranged on the front side of the refrigeration appliance.

As a result, the technical advantage is achieved that by arranging the actuating element on the front side of the refrigeration appliance, the actuating element can be easily reached and actuated by the user of the refrigeration appliance. The refrigeration appliance is in most cases mounted with the back side on a wall. Since the door of the refrigeration appliance is disposed on the front side of the refrigeration appliance, the arrangement of the actuating element on the front side of the refrigeration appliance is advantageous. Therefore the user of the actuating element can control the actuating element from the front side, and does not need to move the refrigeration appliance in order to clean the surface of the refrigeration appliance component.

In a further advantageous embodiment of the refrigeration appliance, the refrigeration appliance component and the cleaning element are arranged on the back side of the refrigeration appliance.

As a result, the technical advantage is achieved that by arranging the refrigeration appliance component and the cleaning element on the back side of the refrigeration appliance, the cleaning element is arranged advantageously close to the refrigeration appliance component. This permits adequate cleaning of the surface of the refrigeration appliance component. The cleaning element is connected on the back side of the refrigeration appliance to the connection element, which extends in the cavity from the back side of the refrigeration appliance to the front side of the refrigeration appliance. On the front side of the refrigeration appliance the connection element is connected to the actuating element so that an effective transmission of the movement of the actuating element by the connection element onto the cleaning element on the back side of the refrigeration appliance is ensured.

In a further advantageous embodiment of the refrigeration appliance, the actuating element comprises a manual actuating element, preferably a handle.

As a result, the technical advantage is achieved that the manual actuating element, such as e.g. the handle, permits an actuation of the actuating element by the user. The handle can be gripped by the user of the refrigeration appliance on the front side and moved in the desired direction of movement.

In a further advantageous embodiment of the refrigeration appliance, the actuating element comprises an automatic actuating element, preferably a switch, a push button or a spring element.

As a result, the technical advantage is achieved that by using the automatic actuating element, actuation of the actuating element and as a result the cleaning process of the cleaning device can be carried out automatically. For instance, the automatic actuation of the actuating element can be achieved by turning the switch or by pushing the push button. Alternatively, the automatic actuation can be achieved by releasing or compressing a spring element. By means of the automatic actuation of the actuating element, the actuating element can be moved, wherein the movement is transmitted by the connection element onto the cleaning element.

In a further advantageous embodiment of the refrigeration appliance, the refrigeration appliance comprises a refrigeration appliance door, wherein the automatic actuating element can be actuated by opening the refrigeration appliance door.

As a result, the technical advantage is achieved that by connecting the automatic actuating element with the refrigeration appliance door, an effective automatic actuation of the actuating element and as a result an automatically introduced cleaning process of the cleaning device can be carried out. For instance, the switch or the push button or the spring element can be integrated into the refrigeration appliance door such that when the refrigeration appliance door is opened or closed, an automatic actuation of the automatic actuating element is achieved, as a result of which an automatic cleaning of the surface of the refrigeration appliance component is ensured by the cleaning element. Automatic cleaning can thus be achieved solely by opening or closing the refrigeration appliance door, as a result of which the user can dispense with a manual actuation of the actuating element.

In a further advantageous embodiment of the refrigeration appliance, the refrigeration appliance comprises a control device for controlling the automatic actuating element.

As a result, the technical advantage is achieved that an automatic actuation of the actuating element can be ensured by the control device irrespective of the use of the refrigeration appliance. For instance, the control device can automatically actuate the actuating element at certain time intervals and e.g. at certain time intervals carry out a cleaning process of the cleaning device for the duration of a certain time interval.

In a further advantageous embodiment of the refrigeration appliance, the connection element is arranged opposite to the cleaning element at an angle of 60° to 120°, preferably at an angle of 90°.

As a result, the technical advantage is achieved that a particularly effective transmission of the movement of the actuating element by the connection element onto the cleaning element can be ensured by means of the selected arrangement of the connection element opposite to the cleaning element. If the use element is pulled out of or inserted into the refrigeration appliance by the user for instance, then the movement is transmitted onto the cleaning element by the connection element. The approximately rectangular arrangement of connection element and cleaning element can achieve an effective cleaning of the surface of the refrigeration appliance component.

In a further advantageous embodiment of the refrigeration appliance, the refrigeration appliance component comprises a condenser, an evaporator, a compressor or a throttle organ.

As a result, the technical advantage is achieved that with the cited refrigeration appliance components, an effective cleaning of the surface of the refrigeration appliance by the cleaning element is ensured. In particular, with a condenser or a compressor, a plurality of dirt deposits, which can be effectively removed by the cleaning device, accumulate in indentations and elevations due to the large surface. As a result, an effective dissipation of heat from the cited refrigeration appliance components can be achieved and the function of the cited refrigeration appliance components can be ensured.

In a further advantageous embodiment of the refrigeration appliance, the refrigeration appliance comprises a condenser made of a multi-port extruded pipe.

As a result, the technical advantage is achieved that a condenser made of a multi-port extruded pipe (MPE condenser) has a particularly large surface, to which a plurality of dirt deposits can attach, which can be particularly effectively removed by the cleaning device.

In a further advantageous embodiment of the refrigeration appliance, the condenser made of a multi-port extruded pipe comprises fins.

As a result, the technical advantage is achieved that by arranging fins in the MPE condenser, a large surface is provided for outputting heat from the refrigeration appliance component. A plurality of dirt deposits, which can be effectively removed by the cleaning device, attach to the large surface of the MPE condenser.

In a further advantageous embodiment of the refrigeration appliance, the refrigeration appliance component has a component front side and the cleaning element is movable across the component front side in order to remove dirt deposits from the surface of the component front side of the refrigeration appliance component.

As a result, the technical advantage is achieved that by positioning the cleaning element on the component front side, the surface area of the refrigeration appliance component to which the majority of dirt deposits attach can be cleaned. Since the flow of air introduced in order to cool the refrigeration appliance component strikes the refrigeration appliance component on the component front side, large quantities of dirt deposits, which can be effectively removed by the cleaning device, accumulate on the surface of the component front side.

In a further advantageous embodiment of the refrigeration appliance, the refrigeration appliance comprises a fan, wherein the refrigeration appliance component comprises a component back side, and wherein the fan is arranged on the component back side.

As a result, the technical advantage is achieved that an effective flow of air for cooling the refrigeration appliance component is generated by using the fan on the component back side. The fan takes in air on the component back side of the refrigeration appliance component, as a result of which air from the front side of the refrigeration appliance component is introduced onto the refrigeration appliance component. Dirt deposits accumulate on the surface of the front side of the refrigeration appliance component. The cleaning element is disposed on the front side of the refrigeration appliance component. Since the fan is disposed on the component back side of the refrigeration appliance component, the position of the fan does not however negatively affect the function of the cleaning element, which is moved across the component front side of the refrigeration appliance component.

BRIEF DESCRIPTION OF THE SEVERAL VIEWS OF THE DRAWING

Further exemplary embodiments are explained with reference to the appended drawings, in which.

DESCRIPTION OF THE INVENTION

Figure 1:
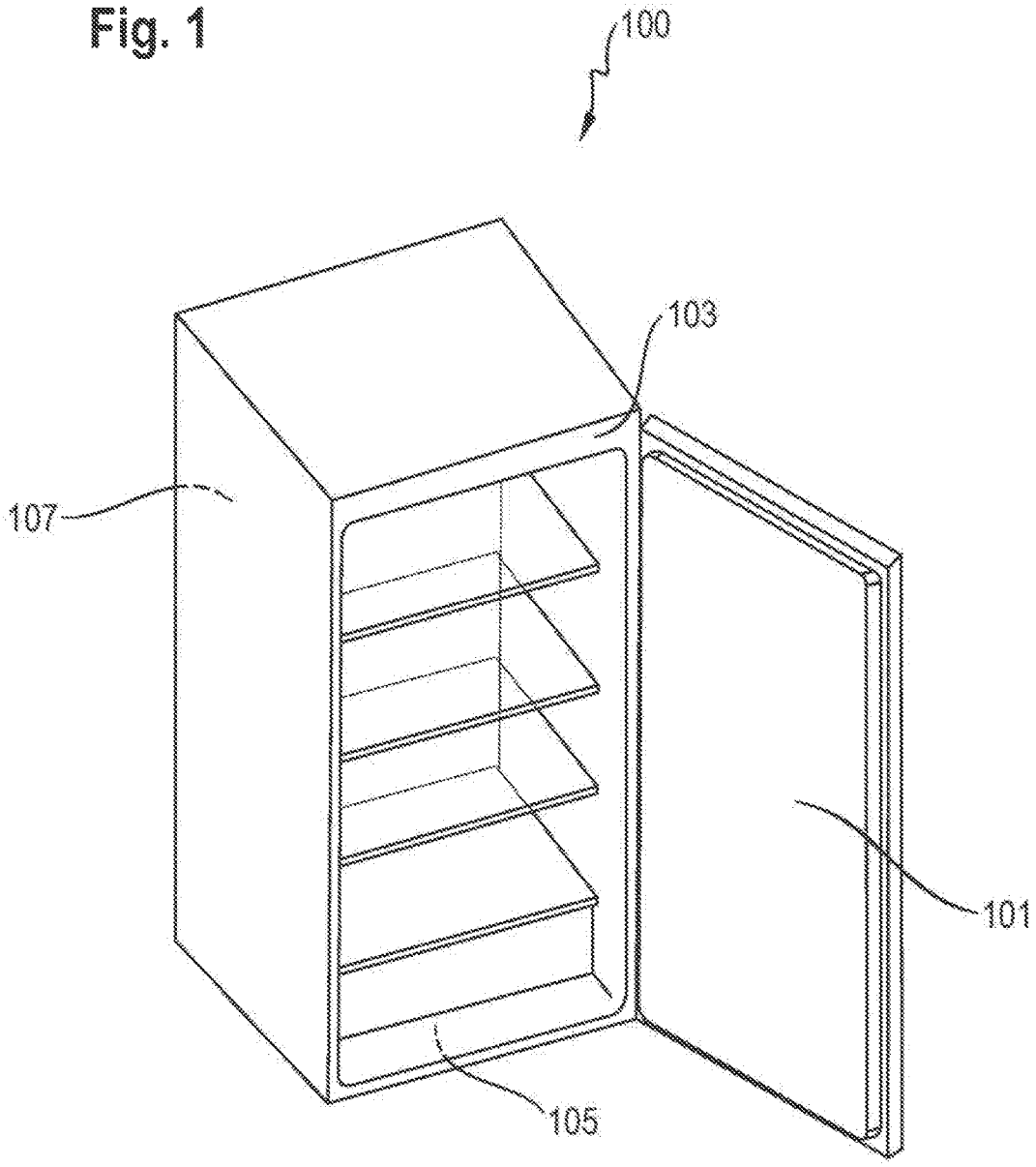
FIG. 1 shows a schematic representation of a refrigeration appliance.

FIG. 1 shows a refrigerator representative of a general refrigeration appliance 100 with a refrigeration appliance door 101 on the front side 103 of the refrigeration appliance 100, by means of which the interior of the general refrigeration appliance 100 can be closed. The refrigeration appliance 100 has an underside 105 and a back side 107.

The refrigeration appliance 100 comprises a refrigeration circuit with an evaporator, compressor, condenser and throttle organ. The evaporator is a heat exchanger, in which, after expansion, the liquid refrigerant is evaporated by absorbing heat from the medium to be cooled, e.g. air. The compressor is a mechanically operated component, which takes refrigerant vapor from the evaporator and outputs the same to the condenser at a higher pressure. The condenser is a heat exchanger, in which, after compression, the evaporated refrigerant is condensed by outputting heat to an external cooling medium, e.g. air. The throttle organ is an apparatus for continuously reducing the pressure by means of cross-sectional constriction. The refrigerant is a fluid, which is used for transmitting heat in the cold-generating system, which absorbs heat at low temperatures and at a low pressure of the fluid and outputs heat at a higher temperature and higher pressure of the fluid, wherein this usually involves state changes in the fluid.

Figure 2:
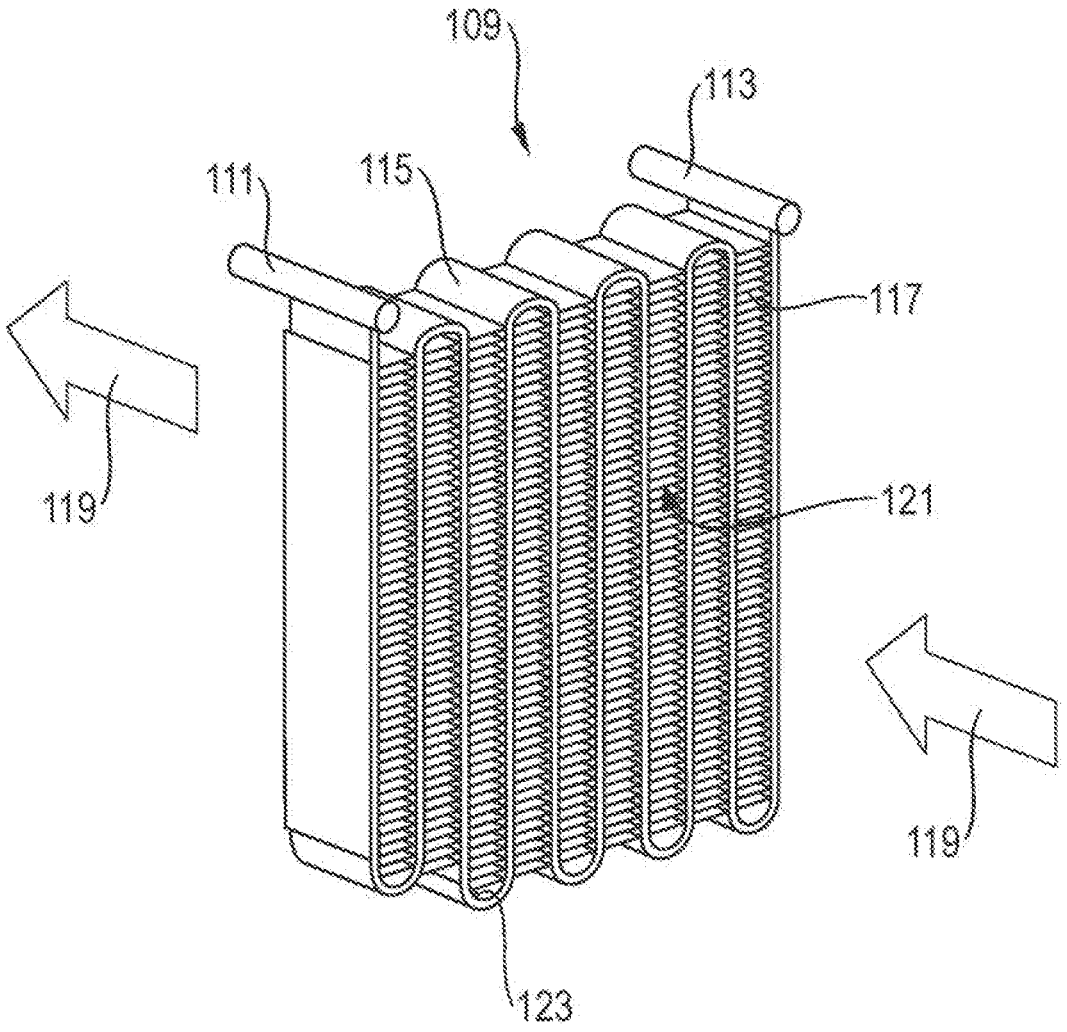
FIG. 2 shows a schematic representation of a refrigeration appliance component as a comparable example.

FIG. 2 shows as a comparable example a schematic representation of a refrigeration appliance component 109, in particular a condenser made of an extruded MPE pipe 115 (MPE condenser). The refrigeration appliance component 109 comprises a first and second attachment 111, 113 for accommodating an input pipe or an output pipe, through which the refrigerant of the refrigeration circuit can be routed into or out of the refrigeration appliance component 109. The refrigeration appliance component 109 comprises an extruded MPE pipe 115, through which the refrigerant is routed and which has a meander-shaped structure. Fins 117 which permit an effective heat output through the refrigeration appliance component 109 to the environment are attached between the meander-shaped sections of the extruded MPE pipe 115. An effective heat output through the refrigeration appliance component 109 is achieved as a result that a flow of air in the flow direction 119 is routed onto the component front side 121 of the refrigeration appliance component 109, absorbs the heat from the refrigeration appliance component 109 and the heated air is led off in the flow direction 119 from the back side 107 of the refrigeration appliance component 109. The flow of air in the flow direction 119 is generated by a fan 134 disposed on the component back side.

If heated refrigerant is routed through the extruded MPE pipe 115, a quantity of heat can be output by the refrigerant through the fins 117 to the outer area of the refrigeration appliance component 109 in order to achieve a condensing of the refrigerant.

During the operation of the refrigeration appliance 100, dirt deposits 123 may however appear on the component front side 121 of the refrigeration appliance component 109, which deposit between the fins 117 of the refrigeration appliance component 109, for instance. If large quantities of dirt deposits 123 have formed, the effectiveness of the heat dissipation of the refrigeration appliance component 109 can be reduced, which can also reduce the overall effectiveness of the refrigeration circuit of the refrigeration appliance 100.

Figure 3:
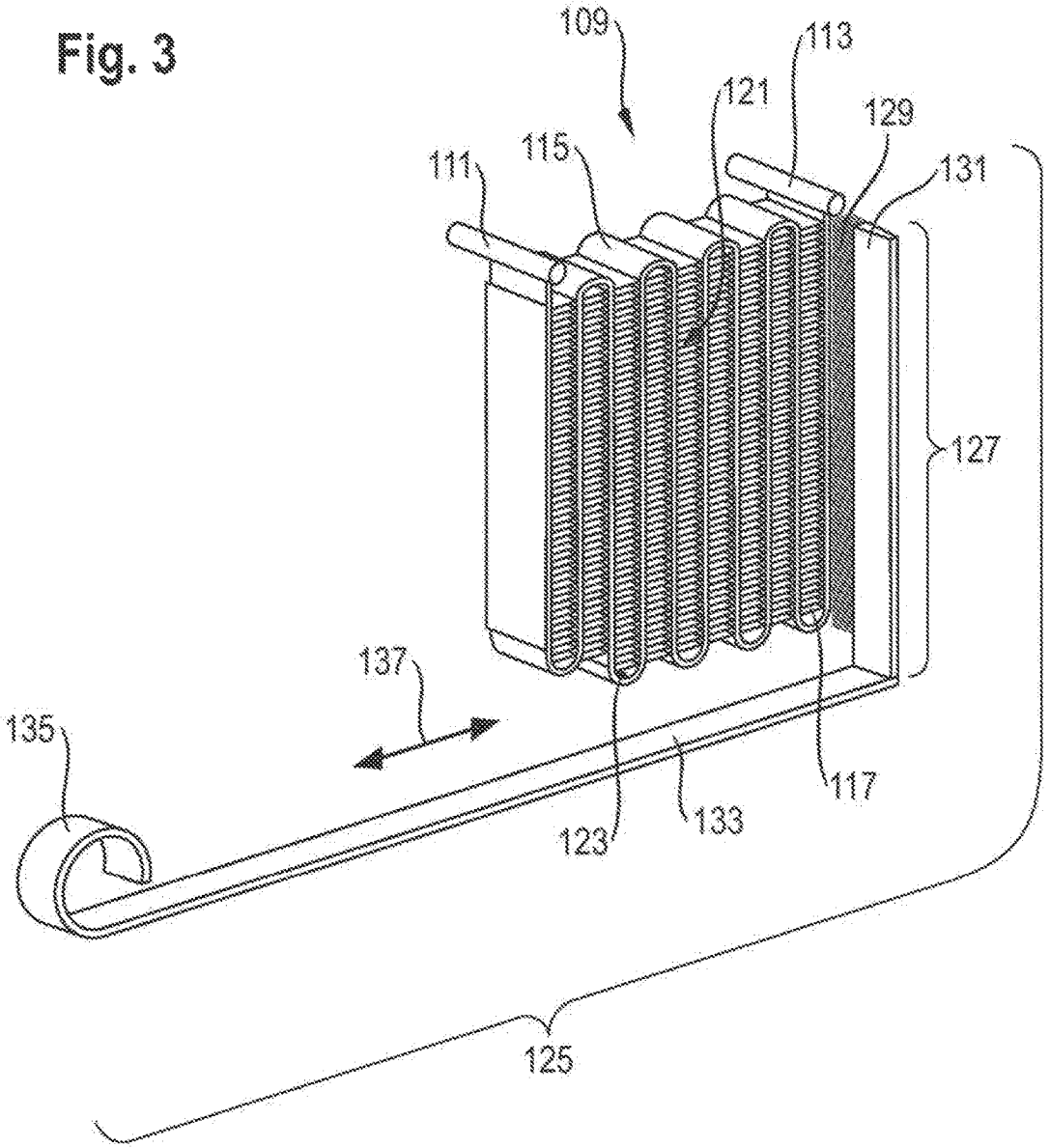
FIG. 3 shows a schematic representation of a refrigeration appliance component with a cleaning device.

In accordance with the present invention, FIG. 3 shows a schematic representation of a refrigeration appliance component 109, such as a condenser according to FIG. 2 with a cleaning device 125. The cleaning device 125 comprises a cleaning element 127 for removing dirt deposits 123 from the component front side 121 of the refrigeration appliance component 109. The cleaning element 127 can comprise a brush. The brush comprises a brush edging 129 and a brush rear 131. The brush edging 129 can consist of synthetic material such as synthetic fibers or metal fibers, or can consist of natural material, such as e.g. natural fibers. The brush edging 129 of the cleaning device 125 is in direct contact with the component front side 121 of the refrigeration appliance component 109.

The brush rear 131 is connected to an actuating element 135 by a connection element 133, such as a handle for instance, on the front side 103 of the refrigeration appliance 100. On the front side 103 of the refrigeration appliance 100, the actuating element 135 projects out of the refrigeration appliance 100 and can be operated by the user of the refrigeration appliance 100. During a cleaning process, the user moves the actuating element 135 along the cleaning axis 137. By moving the actuating element 135, the brush edging 129 of the cleaning element 127 is moved across the component front side 121 of the refrigeration appliance component 109 along the cleaning axis 137, as a result of which dirt deposits 123 on the component front side 121 of the refrigeration appliance component 109 can be removed.

As a result, a constant removal of dirt deposits 123 from the refrigeration appliance component 109 can be achieved by the user of the refrigeration appliance 100, as a result of which an effective heat dissipation from the refrigeration appliance component 109 and a high effectiveness of the refrigeration circuit of the refrigeration appliance 100 can be ensured.

Figure 4:
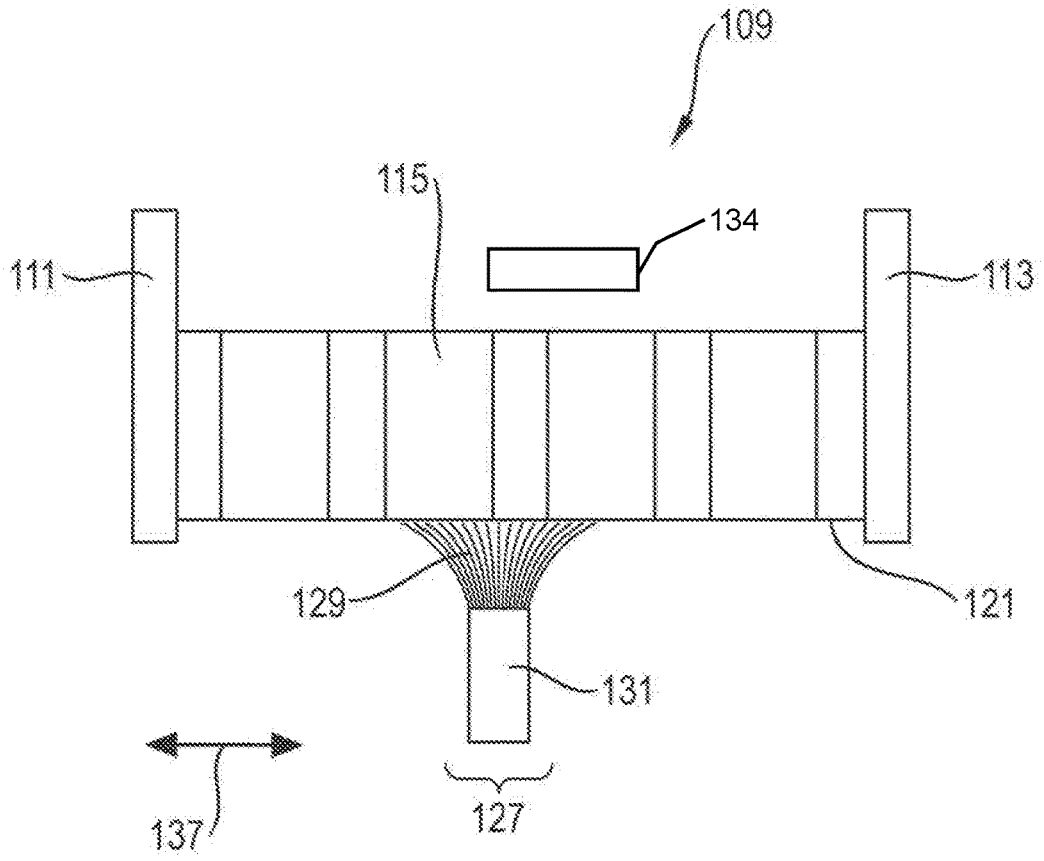
FIG. 4 shows a top view onto a refrigeration appliance component with a cleaning element.

FIG. 4 shows a top view onto a refrigeration appliance component 109, such as a condenser with a cleaning element 127 according to FIG. 3. The refrigeration appliance component 109 comprises a first and second attachment 111, 113 and an extruded MPE pipe 115 through which refrigerant is routed. A cleaning element 127, which has a brush edging 129 and a brush rear 131, is arranged on the component front side 121 of the refrigeration appliance component 109. If the cleaning element 127 is moved along the cleaning axis 137 by the user of the refrigeration appliance 100, the brush edging 129 runs across the component front side 121 of the refrigeration appliance component 109 along the cleaning axis 137, as a result of which dirt deposits 123 on the component front side 121 of the refrigeration appliance component 109 can be removed.

Figure 5:
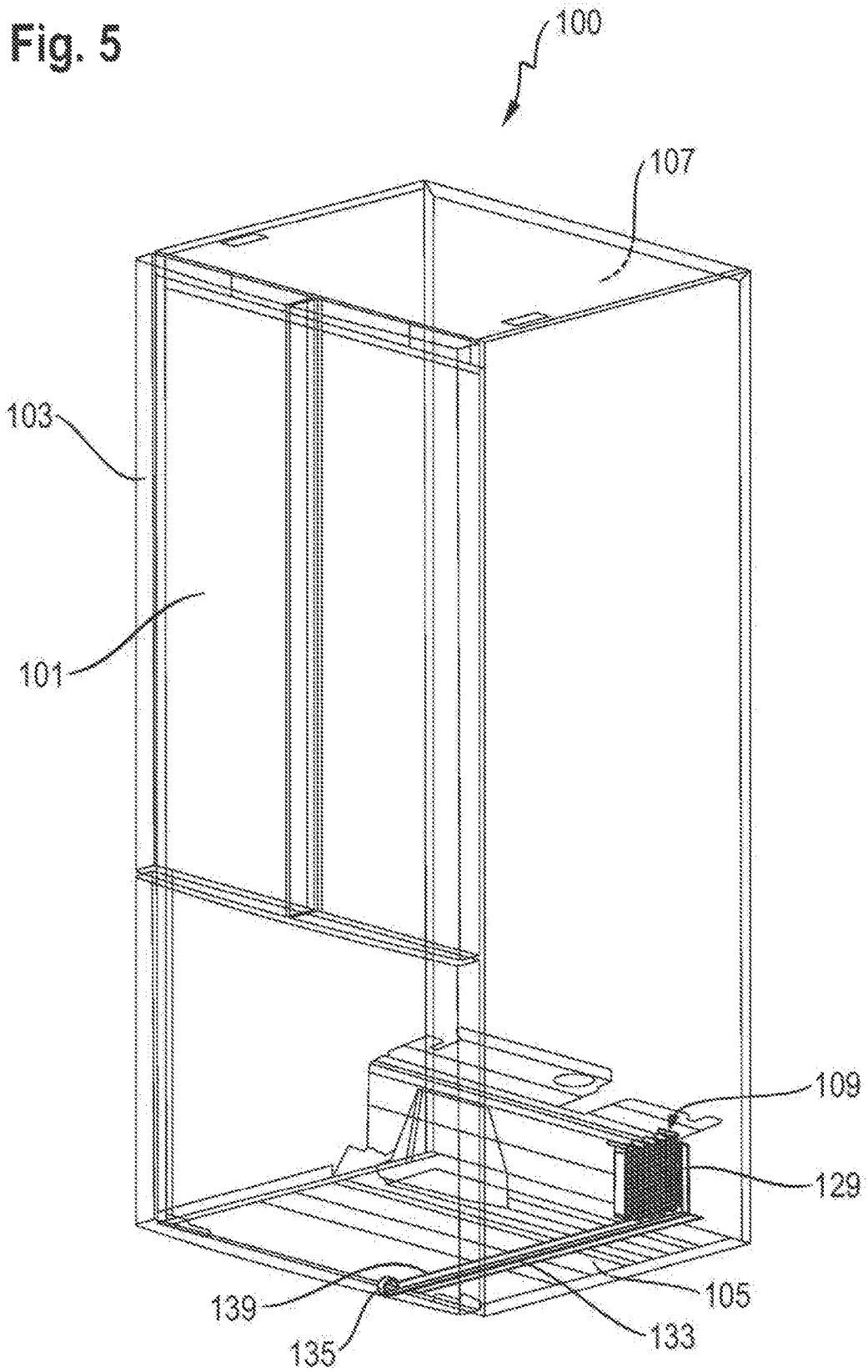
FIG. 5 shows a schematic representation of a refrigeration appliance with a refrigeration appliance component and with a cleaning element.

According to the present invention FIG. 5 shows a schematic representation of a refrigeration appliance 100 with a refrigeration appliance component 109, such as a condenser, and with a cleaning element 127. The refrigeration appliance 100 comprises a front side 103, on which a refrigeration appliance door 101 is arranged, by means of which the refrigeration appliance 100 can be opened, and a back side 107 and an underside 105. The refrigeration appliance component 109 of the refrigeration circuit is attached in the vicinity of the back side 107 and the underside 105 of the refrigeration appliance 100.

An actuating element 135 which is connected by a connection element 133 to a cleaning element 127, which has a brush edging 129, is attached to the front side 103 of the refrigeration appliance 100. The connection element 133 is disposed in a cavity 139, which extends from the front side 103 of the refrigeration appliance 100 to the back side 107 of the refrigeration appliance 100.

By moving the actuating element 135, the brush edging 129 can be moved across the surface of the refrigeration appliance 109 in order to remove impurities.

An effective removal of dirt deposits 123 from the component front side 121 of the refrigeration appliance component 109 can be achieved by the user moving the actuating element 135 in the opposite direction. As a result, an adequate quantity of air can be routed to the refrigeration appliance component 109, in order to ensure an effective cooling of the refrigeration appliance component 109, as a result of which an adequate degree of efficiency of the refrigeration circuit of the refrigeration appliance 100 is ensured.

All features shown and explained in conjunction with the individual embodiments of the invention can be provided in a different combination in the inventive subject matter in order at the same time to realize their advantageous effects.

The scope of protection of the present invention is provided by the claims and is not restricted by the features explained in the description or shown in the figures.

LIST OF REFERENCE CHARACTERS

100 Refrigeration appliance
101 Refrigeration appliance door
103 Front side of the refrigeration appliance
105 Underside of the refrigeration appliance
107 Back side of the refrigeration appliance
109 Refrigeration appliance component
111 First attachment
113 Second attachment
115 Extruded MPE pipe
117 Fins
119 Direction of flow of air
121 Component front side
123 Dirt deposits
125 Cleaning device
127 Cleaning element
129 Brush edging
131 Brush rear
133 Connection element
135 Actuating element
137 Cleaning axis
139 Cavity

The invention claimed is:

1. A refrigeration appliance, comprising:

a refrigeration appliance housing having a front side and a back side;

a refrigeration appliance component having a surface to be cleaned;

a cleaning device for cleaning said refrigeration appliance component, said cleaning device including a cleaning element, said cleaning element being a brush or a lip, an actuating element and a connection element connecting said actuating element to said cleaning element;

said actuating element being a manual actuating element provided as a handle disposed at said front side of said refrigeration appliance housing and projecting out of the refrigeration appliance for actuation by a user;

the refrigeration appliance housing being formed with a cavity that extends from said front side to said back side;

said connection element being movably disposed in said cavity; and wherein when said actuating element is actuated, said cleaning element is caused to move across said surface of said refrigeration appliance component in order to remove dirt deposits from said surface of said refrigeration appliance component.

2. The refrigeration appliance according to claim 1, wherein said brush comprises a brush rear and a brush edging, and said brush edging comprises synthetic fibers, natural fibers or metal fibers.

3. The refrigeration appliance according to claim 1, wherein said lip comprises a lip rear or a lip edging and said lip edging comprises a flexible plastic flange.

4. . The refrigeration appliance according to claim 1, wherein said refrigeration appliance component and said cleaning element are arranged at said back side of said refrigeration appliance housing.

5. The refrigeration appliance according to claim 1, wherein said connection element is arranged opposite cleaning element at an angle of between 60° and 120°.

6. The refrigeration appliance according to claim 5, wherein said connection element is arranged opposite said cleaning element at an angle of 90°.

7. The refrigeration appliance according to claim 1, wherein said refrigeration appliance component is a condenser.

8. The refrigeration appliance according to claim 7, wherein said refrigeration appliance component is condenser made of a multi-port extruded pipe.

9. The refrigeration appliance according to claim 8, wherein said condenser comprises a plurality of fins.

10. The refrigeration appliance according to claim 1, wherein said refrigeration appliance component has a component front side and said cleaning element is disposed to move across said component front side in order to remove dirt deposits from the surface of said component front side.

11. The refrigeration appliance according to claim 1, which further comprises a fan disposed on a rear side of said refrigeration appliance component.

12. A refrigeration appliance, comprising:

a refrigeration appliance housing having a front side and a back side;

a refrigeration appliance component having a surface to be cleaned;

a cleaning device for cleaning said refrigeration appliance component, said cleaning device including a cleaning element, said cleaning element being a brush or a lip, an actuating element and a connection element connecting said actuating element to said cleaning element;

said actuating element being a manual actuating element provided as a handle disposed at said front side of said refrigeration appliance housing and projecting out of the refrigeration appliance for actuation by a user;

said cleaning device having a cleaning device longitudinal extent and said actuator having an actuator longitudinal extent being perpendicular to said cleaning device longitudinal extent;

the refrigeration appliance housing being formed with a cavity that extends from said front side to said back side;

said connection element being movably disposed in said cavity; and wherein when said actuating element is actuated, said cleaning element is caused to move across said surface of said refrigeration appliance component in order to remove dirt deposits from said surface of said refrigeration appliance component.

13. The refrigeration appliance according to claim 12, wherein said actuator is linearly displaceable in said cavity along said actuator longitudinal extent to move the cleaning element across said surface.

* * * * *